US007845876B2

(12) United States Patent
Burry et al.

(10) Patent No.: US 7,845,876 B2
(45) Date of Patent: Dec. 7, 2010

(54) RACING GATE

(75) Inventors: James M. Burry, Troutman, NC (US); Daniel R. Seymour, Mooresville, NC (US)

(73) Assignee: BISS Product Development LLC, Troutman, NC (US)

( * ) Notice: Subject to any disclaimer, the term of this patent is extended or adjusted under 35 U.S.C. 154(b) by 926 days.

(21) Appl. No.: 11/672,229

(22) Filed: Feb. 7, 2007

(65) Prior Publication Data

US 2007/0207868 A1 Sep. 6, 2007

Related U.S. Application Data

(60) Provisional application No. 60/774,114, filed on Feb. 16, 2006.

(51) Int. Cl.
*E01F 13/04* (2006.01)

(52) U.S. Cl. ..... 404/6; 49/49

(58) Field of Classification Search ..... 404/6, 404/9; 49/49

See application file for complete search history.

(56) References Cited

U.S. PATENT DOCUMENTS

| | | | | |
|---|---|---|---|---|
| 3,849,936 | A * | 11/1974 | Geraci | 49/35 |
| 3,994,491 | A | 11/1976 | Mascotte et al. | |
| 4,134,230 | A | 1/1979 | Roy | |
| 4,367,975 | A * | 1/1983 | Tyers | 404/6 |
| 5,466,088 | A * | 11/1995 | Nasatka | 404/6 |
| 7,477,133 | B2 * | 1/2009 | Abdulkader | 340/323 R |
| 7,665,929 | B2 * | 2/2010 | Barker et al. | 404/6 |
| 2005/0069383 | A1 | 3/2005 | Gunderson | |
| 2005/0206519 | A1 | 9/2005 | Tsui et al. | |
| 2005/0275364 | A1 | 12/2005 | Robb et al. | |
| 2006/0029467 | A1 | 2/2006 | Johnson | |
| 2008/0222960 | A1 * | 9/2008 | Williams et al. | 49/324 |

* cited by examiner

*Primary Examiner*—Gary S Hartmann
(74) *Attorney, Agent, or Firm*—Hammer & Associates, P.C.

(57) ABSTRACT

A race gate has a base and a start bar connected to the base, where the start bar has an elevated start position and a level finish position. A release mechanism interconnects the base and the start bar and retains the start bar in the start position. A controller governs the release mechanism. The controller may be programmable to measure a preset time period and a random time period.

17 Claims, 5 Drawing Sheets

RACING GATE

RELATED APPLICATION

This application claims the benefit of provisional application Ser. No. 60/774,114 filed Feb. 16, 2006.

FIELD OF THE INVENTION

Racing gates for vehicles are discussed herein.

BACKGROUND OF THE INVENTION

Racing of motocross and supercross motorcycles, motocross bicycles (BMX), and all-terrain vehicles (ATV's) has gained in popularity in the past three decades. At the start of a race, the riders position themselves shoulder-to-shoulder in a straight line behind a starting gate. Prior to the start of the race, the start bar of the starting gate is in an elevated position so that the bottom of the start bar is higher than the axle of the racer's front tire(s). The race begins as the start bars are manually dropped from the elevated position to a relatively flat position to enable the racers to navigate over the start bar. If a racer attempts to start the race prior to the start bar dropping from the elevated position, the racer's front tire will wedge under the start gate and prevent its descent. This ensures a fair start for all racers.

The start of a race requires sharp reflexes. According to the rule book of one pro-racing organization (http://www.amaproracing.com/prorace/pdf/07_SXMX_GdLR.pdf), a starter holds up a "30-second" sign for 30 seconds immediately prior to the start of a race. The starter then turns the sign sideways for 5 to 10 seconds and during that time the start gate will drop randomly, signaling the start of the race. Thus, due to the random timing of the start bar drop, there is a need for racers to practice and hone their reflexes to obtain faster reaction times and better race starts.

U.S. Pat. No. 3,994,491 discloses a multiple rider starter gate for motorcycle races that uses a plurality of cables strung across each starter position. The gate is substantially vertical when the starter mechanically actuates the gate. The gate falls forward, away from the driver, to a horizontal position. A latch holds the cable mounting member in vertical position prior to the start of the race. The starting gate requires a person other than the racer to actuate the dropping of the gate. The starting gate provides no means for electronically or remotely dropping the cable-strung gate.

U.S. Pat. No. 4,134,230 discloses a multiple rider starter gate for motorcycle racing. However, the gate is not portable due to its size and design. Additionally, to actuate the starter gate, a person, other than the driver must physically depress the start handle.

U.S. Patent Application No. 2005/0069383 discloses a portable motorcycle starting gate that allows a driver to practice starts. A spring loaded latching pin is used as the release mechanism for the gate. Either a lanyard or a solenoid operated by a push-button switch releases the latching pin. This design allows a rider to operate the start gate by themselves. However, a person other than the rider must pull the lanyard or activate the push button to randomly actuate the starting gate. Additionally, a driver cannot remotely operate the gate to provide a random start.

U.S. Patent Application No. 2006/0029467 discloses a starting gate for motorcycles. A foot pedal is used to manually release the gate after a preset period of time. A single rider may operate the gate without the aid of other persons. Again, this application fails to disclose a means for the driver to remotely operate the gate to provide a random start.

Hence, there exists an unsatisfied need for a practice start gate capable of providing both preset and random starts that an individual can operate by themselves.

SUMMARY OF THE INVENTION

A race gate has a base and a start bar connected to the base, where the start bar has an elevated start position and a level finish position. A release mechanism interconnects the base and the start bar and retains the start bar in the start position. A controller governs the release mechanism. The controller may be programmable to measure a preset time period and a random time period.

BRIEF DESCRIPTION OF THE DRAWINGS

For the purpose of illustrating the invention, there is shown in the figures a form that is presently preferred; it being understood, however, that this invention is not limited to the precise arrangements and instrumentalities shown.

DETAILED DESCRIPTION

Figure 1:
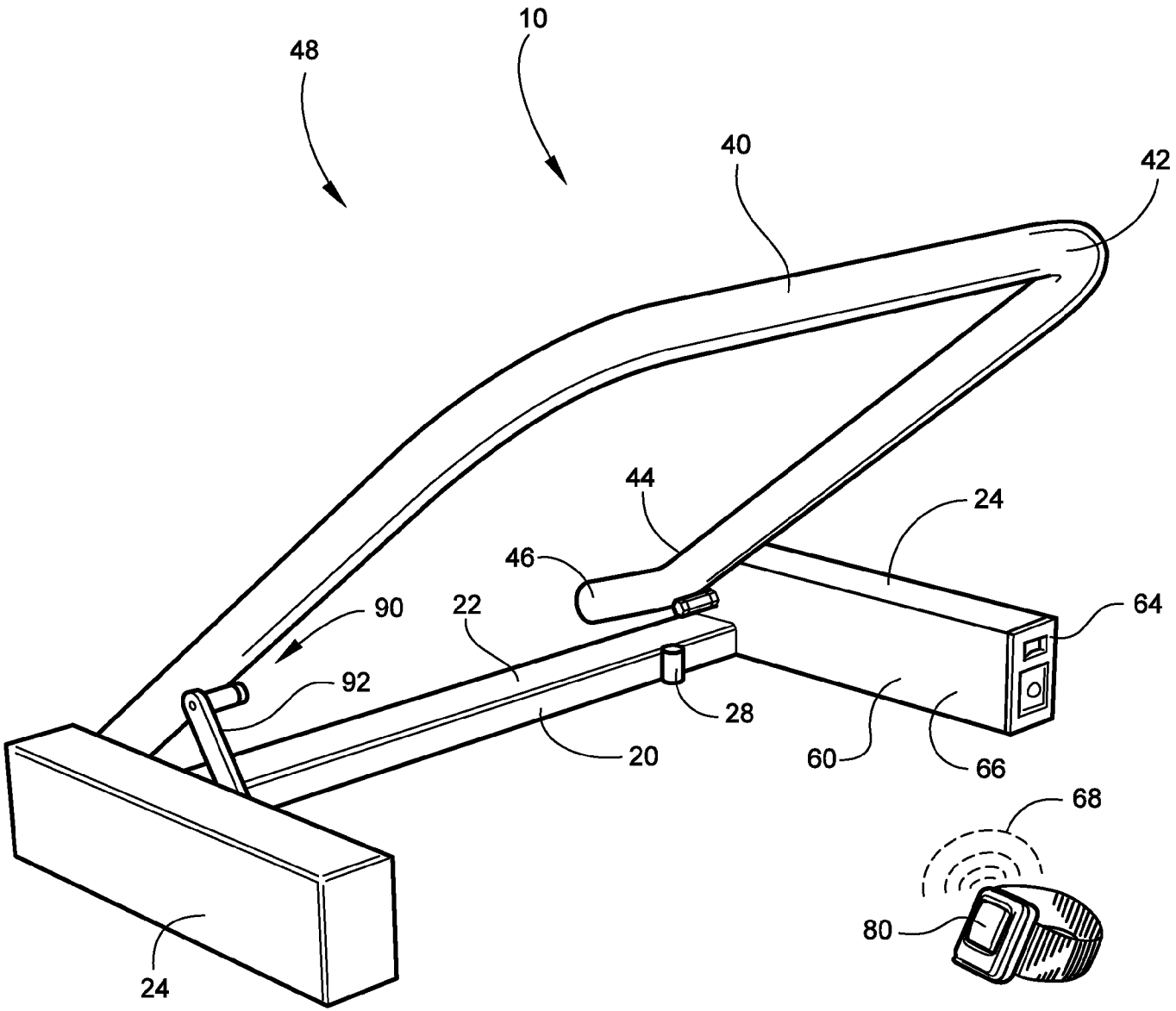
FIG. 1 illustrates an embodiment of a race gate in a start position with a wireless signal.

Referring to the drawings, wherein like numerals indicate like elements, there is shown in FIG. 1 an embodiment of a race gate 10. Race gate 10 may be used as a starting race gate for any vehicle including, but not limited to, a bicycle, a motorcycle, an ATV, and the like. A race gate 10, in one embodiment, provides a portable means for racers to practice starts either with the aid of another person, or by themselves. The practice start times may be programmed to be preset time periods, random time periods, or both. A starter may actuate the start time either manually, by wire, or wirelessly. Additionally, one may link a plurality of race gates in series to permit both large and small groups to practice the "hole shot" of taking the lead into the first turn of a race.

A race gate may be comprised of basic components such as a base 20, a start bar 40, a controller 60, and a release mechanism 90.

A base 20 provides a stable platform on which the remainder of the race gate is constructed. The base 20 may include a crossbar 22 and two endbars 24. The crossbar 22 attaches one of its ends to a side of the first of two endbars 24. The crossbar 22 then attaches its opposite end to the side of the second of two endbars 24. The crossbar 22 may be attached anywhere along the length of the side of each endbar 24. The crossbar 22 may be comprised of any material durable enough to remain functionally intact after numerous vehicle starts. Suitable crossbar 22 materials include, but are not limited to, metal, plastic, wood, or combinations thereof. The crossbar 22 may have a shape selected from the group consisting of rectangle, square, circle, semicircle, triangle, oblong, oval, tetrahedral, trapezoid, diamond, or combinations thereof. The crossbar 22 will preferably possess a flat surface facing away from the ground in order to more easily facilitate vehicles driving over the race gate 10 at the start of a race.

An endbar 24 may be comprised of any material durable enough to remain functionally intact after numerous vehicle starts. Suitable endbar 24 materials include, but are not limited to, metal, plastic, wood, or combinations thereof. The endbar 24 may have a shape selected from the group consisting of rectangle, square, circle, semicircle, triangle, oblong, oval, tetrahedral, trapezoid, diamond, or combinations thereof. The endbar 24 will preferably possess a flat surface facing the ground in order to provide greater stability for the race gate 10.

Figure 5:
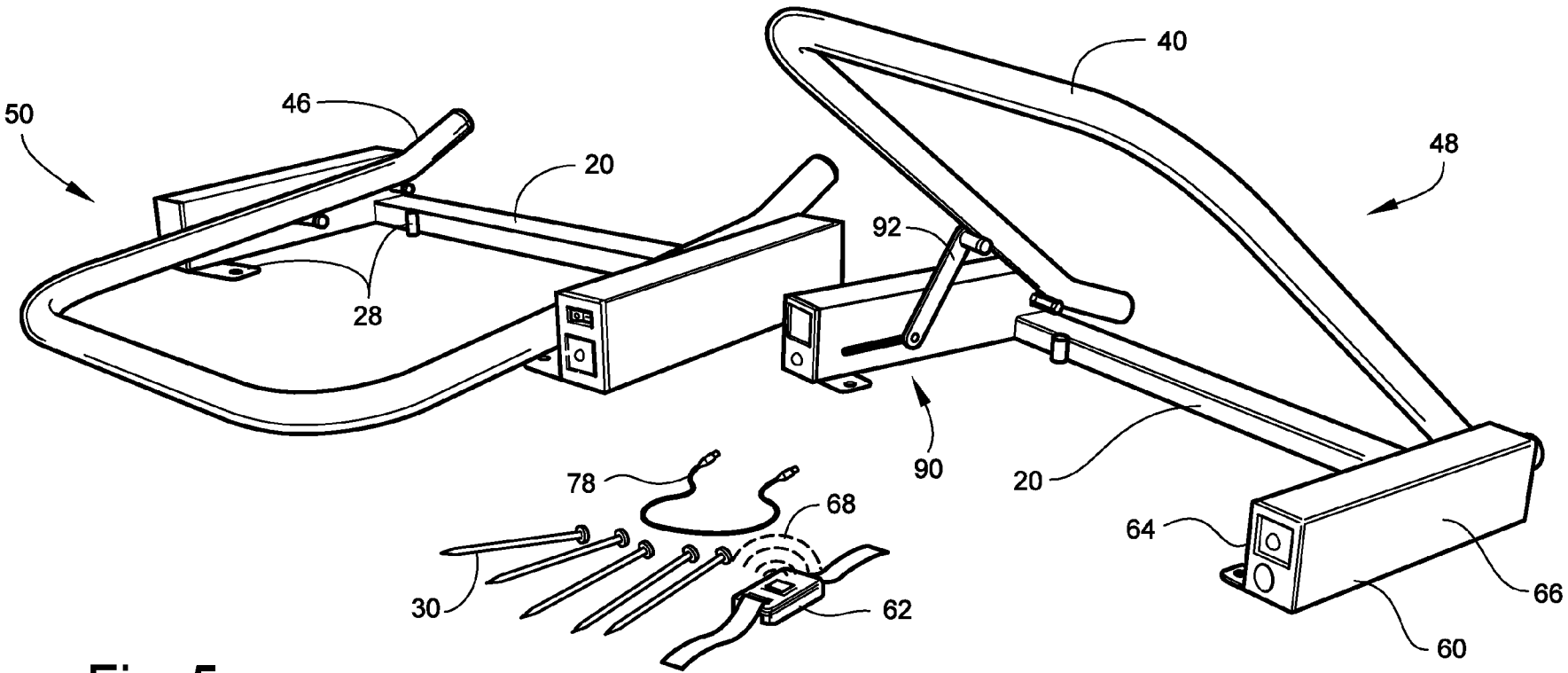
FIG. 5 illustrates a pair of race gates and the associated equipment required to start multiple racers.

In one potential embodiment of the present invention one or more stabilizing bracket 28 may be attached to the base 20 to aid in stabilizing the race gate 10. The stabilizing bracket 28 may be comprised of any material durable enough to remain functionally intact after numerous vehicle starts. Suitable stabilizing bracket 28 materials include, but are not limited to, metal, plastic, wood, or combinations thereof. FIG. 5 illustrates an alternative embodiment of a stabilizing mount 30 and a stabilizing bracket 28.

A stabilizing mount 30 works in conjunction with the stabilizing bracket 28 to aid in stabilizing the race gate 10. The stabilizing mount 30 may take the form of, but is not limited to, a nail, a spike, a screw, a bolt, a staple, a dowel, or a peg. Suitable stabilizing mount 30 materials include, but are not limited to, metal, plastic, wood, or combinations thereof.

A start bar 40 is the race gate component that physically controls the start of a race. The start bar 40 may be connected to the base 20 via one or more connection points 44 which allow the start bar to move between a start position 48 and a finish position 50. In one embodiment, the start bar 40 may be pivotally connected to the base 20. In an alternative embodiment, the start bar 40 may be pivotally connected to the endbars 24 of the base 20. As illustrated in FIG. 1, the start bar may consist of a U-shaped bar. In an alternative embodiment, the start bar may consist of an L-shaped bar. The start bar 40 may be comprised of any material durable enough to remain functionally intact after numerous vehicle starts. Suitable star bar 40 materials include, but are not limited to, metal, plastic, wood, or combinations thereof.

As illustrated in FIG. 1, the start bar 40 is in a start position 48. The start position 48, as used herein, means that the start bar 40 is in a substantially elevated position relative to the endbars 24.

Figure 2:
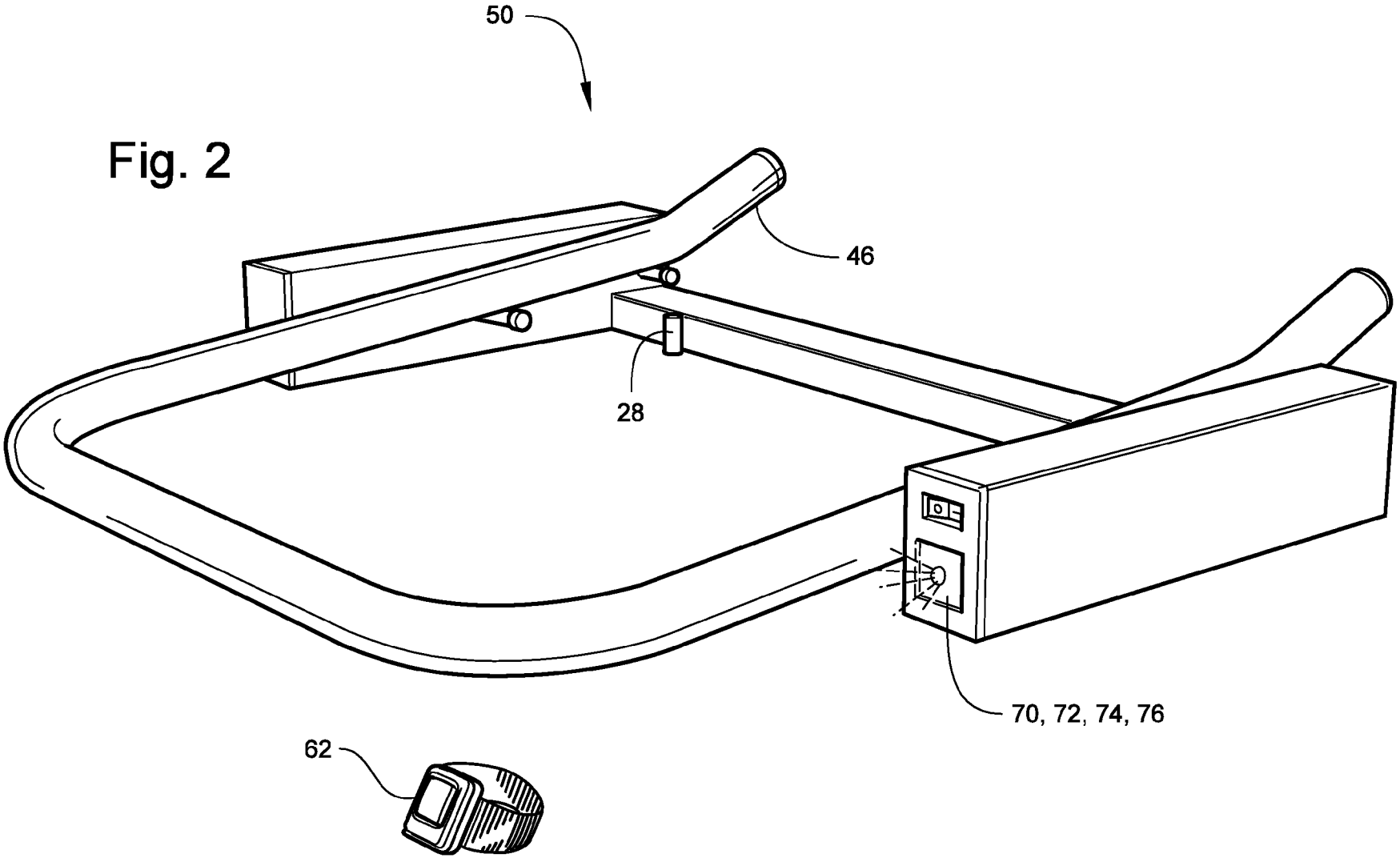
FIG. 2 illustrates the race gate of FIG. 1 in finish position.

As illustrated in FIG. 2, the start bar is in a finish position 50. The finish position 50, as used herein, means that the start bar 40 is in a substantially level position relative to the endbars 24.

The start bar 40 may further comprise a peddle 46. The peddle 46 may be adapted to move the start bar 40 from the finish position 50 to the start position 48. FIG. 2 illustrates one potential embodiment of a race gate wherein the peddle 46 is a part of the start bar 40.

Release mechanism 90, as used herein, refers to a device adapted to releasably hold a start bar 40 in the start position 48. The release mechanism releases the start bar 40 when activated, allowing the start bar 40 to move from the start position 48 to the finish position 50. FIG. 1 illustrates one potential embodiment of a release mechanism comprising an arm interconnecting the base 20 and the start bar 40.

Controller 60, as used herein, refers to a device which may be operatively associated with the release mechanism 90 and adapted to control the release of the start bar after a preset time period 74 and a random time period 76. A controller 60 may be comprised of basic components such as a timer 66, a receiver 64, and a transmitter 62.

Timer 66, as used herein, refers to a device which may be operatively associated with the release mechanism 90 and adapted to control the release of the start bar 40. In an alternative embodiment, the timer 66 may release the start bar 40 after a preset time period 74 and a random time period 76. In yet another embodiment the timer 66 may release the start bar 40 after the preset time period 74. In yet another embodiment the timer 66 may release the start bar 40 after the random time period 76.

Receiver 64, as used herein, refers to a device which may be operatively associated with the release mechanism. The type of signal which the receiver 64 may receive includes, but is not limited to, mechanical, by-wire, wireless, or combinations thereof. In one embodiment, the receiver may be a device which controls the release mechanism. A receiver 64 may receive a signal 68 from a transmitter 62.

The receiver 64 may further comprise a first indicator 70 and a second indicator 72. The first indicator 70, as used herein, provides a means of informing the race gate 10 user that the race gate 10 has received a signal 68. The second indicator 72, as used herein, provides a means of informing the race gate 10 user that the start bar 40 will drop within a preset or random time period. FIG. 2 illustrates one potential embodiment of the first indicator 70 the second indicator 72.

The first indicator 70 and the second indicator 72 may each indicate the initiation of a programmable time period. Programmable time period, as used herein, refers to a time period which may be specifically programmed into a device in order to trigger an event. In one embodiment, the programmable time period may refer to a preset time period 74 (i.e. 10 seconds). In another embodiment, the programmable time period may refer to a random time period 76 (i.e. between 7-15 seconds). The first indicator 70 may indicate the start of the preset time period 74. A second indicator 72 may indicate the start of the random time period 76. In one embodiment, the first indicator 72 and the second indicator 74 may be a dual LED.

Transmitter 62, as used herein, refers to a device which may be operatively associated with the receiver 64. Transmitter 62 may transmit a signal 68 to the receiver 64. The transmitter may generate a signal 68 via a method including, but not limited to, mechanically, by-wire, wirelessly, or combinations thereof. A wireless transmitter 80 emanating a signal 68 is illustrated in FIG. 1.

A signal 68, as used herein, refers to a method of conveying information. The signal 68 may transmitted by any method including, but not limited to, mechanically, by-wire, or wirelessly. In one embodiment, the signal 68 may be conveyed mechanically by means of a Bowden Cable. In yet another embodiment, the signal 68 may be conveyed wirelessly via a remote control.

Figure 3:
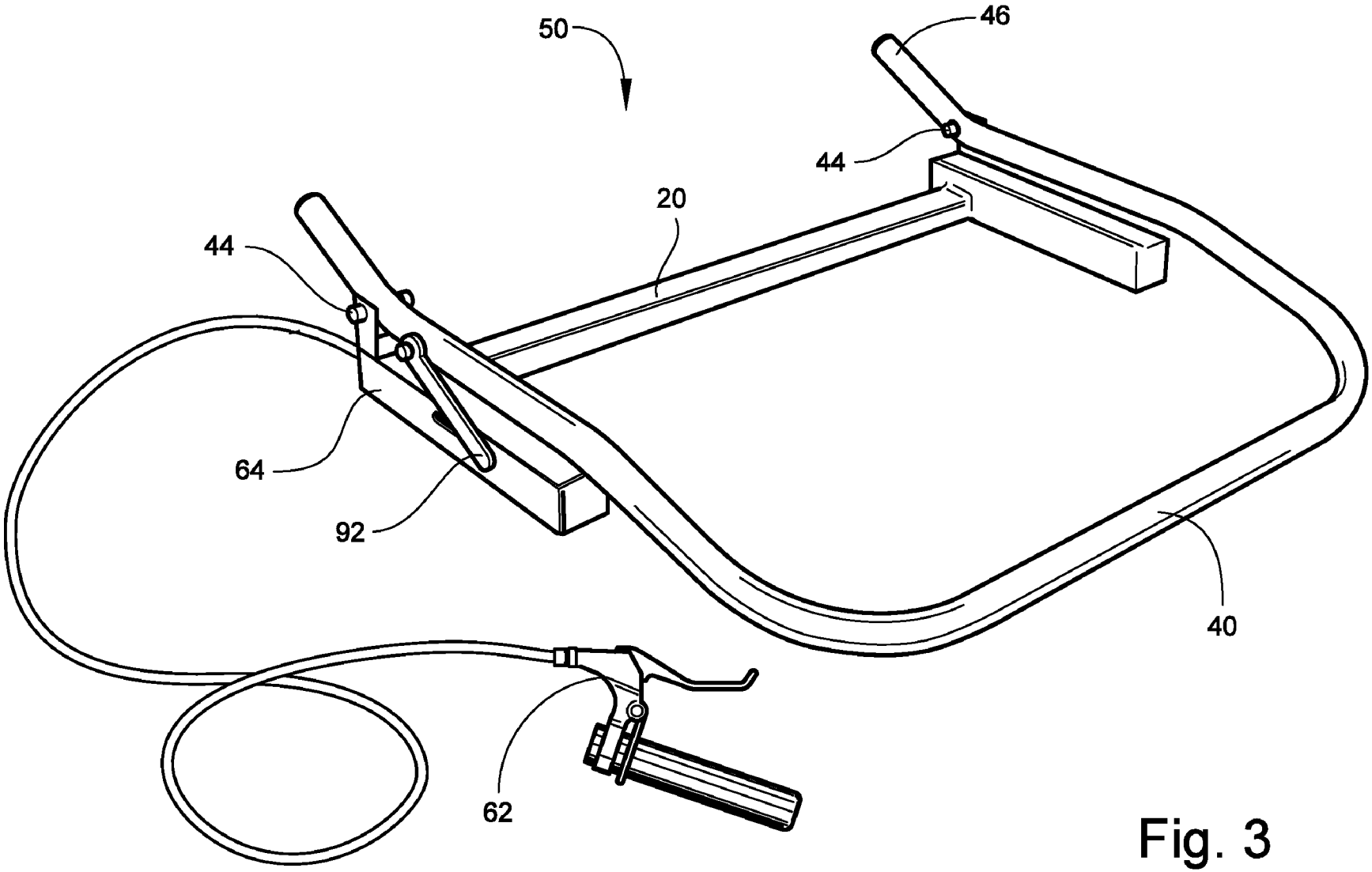
FIG. 3 illustrates an embodiment of a race gate in a finish position with a mechanical signal.
Figure 4:
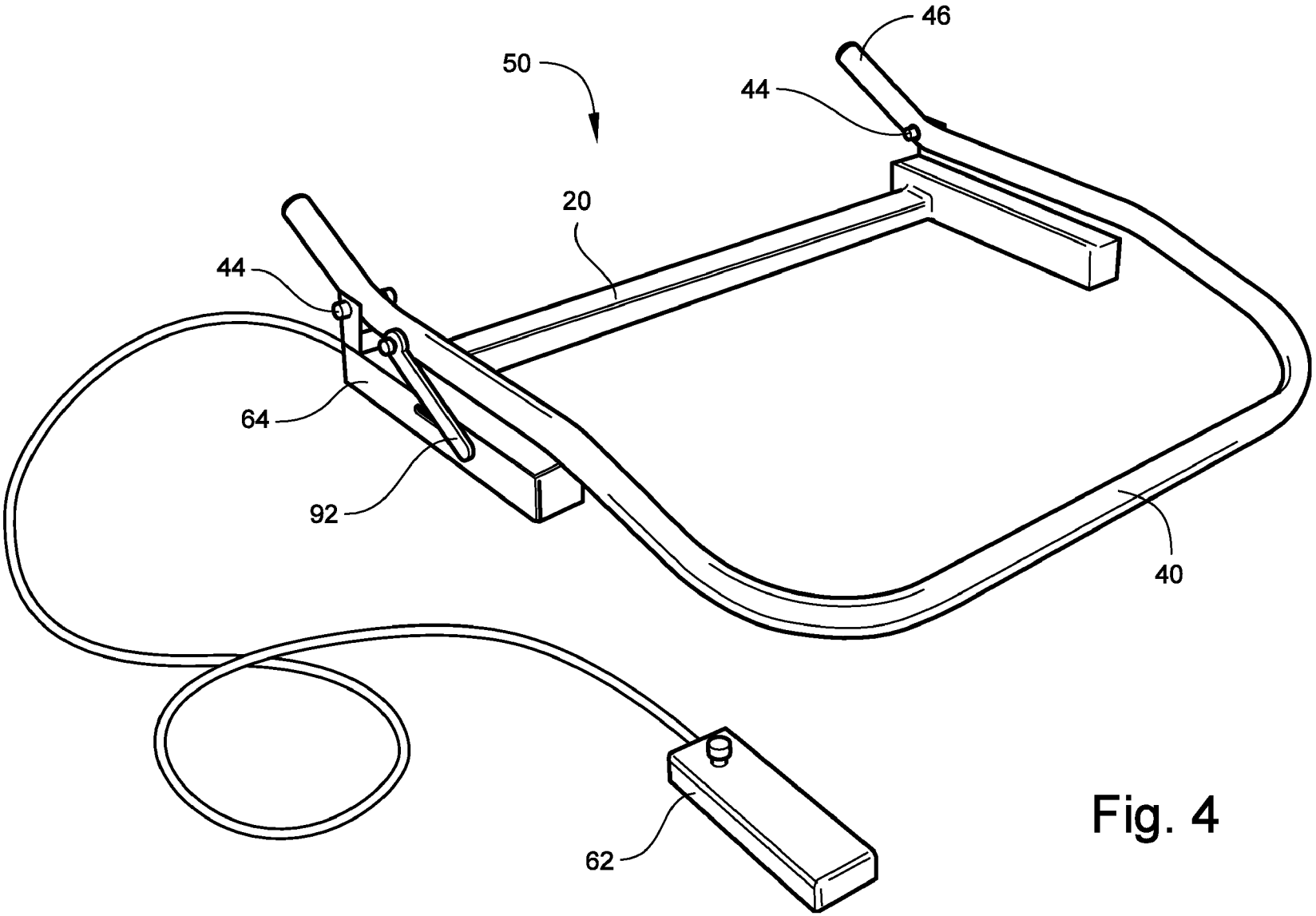
FIG. 4 illustrates an embodiment of a race gate in a finish position with a wired signal.

FIG. 3 illustrates an alternative embodiment of the race gate 10 wherein the transmitter 62 and the receiver 64 are operatively associated with one another mechanically. FIG. 4 illustrates another alternative embodiment of the race gate 10 wherein the transmitter 62 and the receiver 64 are operatively associated with one another by wire.

Operatively associated, as used herein, refers to two or more devices working with one another. Devices may be operatively associated mechanically, by wire, or wirelessly.

FIG. 5 illustrates an alternative embodiment of the present invention wherein two race gates 10 may be operatively associated to one another. FIG. 5 illustrates an embodiment of the present invention wherein two race gates 10 may be operatively associated via a wire connector 78. In another embodiment, two or more race gates 10 may be operatively associated by mechanical connection. In yet another embodiment, two or more race gates 10 may be operatively associated by wireless connection. Race gates which are operatively connected may respond simultaneously or nearly simultaneously to a start signal received to activate the release mechanism and move the start gate from the start position to the finish position.

Master race gate, as used herein, refers to a race gate which is operatively associated with a plurality of race gates. In one embodiment, the master race gate may be a race gate whose controller is operatively associated with a user's transmitter. In another embodiment, the master race gate may be the race gate to which a slave race gates respond to.

Slave race gate, as used herein, refers to a race gate operatively associated with a master race gate. The slave race gate may be a gate whose controller is operatively associated with a master race gate's controller. The slave race gate may respond to a master slave gate's signal.

The present invention may be embodied in other forms without departing from the spirit and the essential attributes thereof, and, accordingly, reference should be made to the appended claims, rather than to the forgoing specification, as indicated in the scope of the invention.

We claim:

1. A race gate comprising:

a base;

a start bar connected to said base, said start bar being movable between a start position and a finish position;

a pedal mounted on said start bar, said pedal being an angled portion extending beyond the connection of said start bar to said base adapted to move said start bar from said finish position to said start position;

a release mechanism interconnecting said base and said start bar and being adapted to releasably hold said start bar in said start position;

a controller operatively associated with said release mechanism and adapted to control the release of said start bar after a random time period;

said controller comprising:

a timer controlling the release of said start bar via said release mechanism;

a receiver operatively associated with said timer; and a transmitter operatively associated with said receiver.

2. The race gate of claim 1 wherein said release mechanism comprising an arm interconnecting said base and said start bar.

3. The race gate of claim 1 wherein said receiver further comprising:

a first indicator that said receiver has received a signal from said transmitter; and a second indicator that said start bar will move from said start position to said finish position.

4. The race gate of claim 1 wherein said transmitter being operatively associated with said receiver through a signal;

wherein said signal being communicated by a method being selected from the group consisting of: mechanically, by wire, wirelessly, or combinations thereof.

5. The race gate of claim 1 wherein said race gate being operatively associated with a plurality of said race gates.

6. The race gate of claim 5 wherein said race gate being operatively associated by a method being selected from the group consisting of: mechanically, by wire, wirelessly, or combinations thereof.

7. The race gates of claim 6 wherein one race gate being a master race gate;

wherein said plurality of said race gates being slave race gates.

8. The race gate of claim 1 wherein said controller being adapted to control the release of said start bar after a preset time period and a random time period.

9. A race gate comprising:

a base;

a start bar connected to said base, said start bar being movable between a start position and a finish position;

a pedal mounted on said start bar, said pedal being an angled portion extending beyond the connection of said start bar to said base adapted to move said start bar from said finish position to said start position;

a release mechanism interconnecting said base and said start bar and being adapted to releasably hold said start bar in said start position;

a receiver operatively associated with said release mechanism and adapted to control the release of said start bar;

a wireless transmitter operatively associated with said receiver.

10. The race gate of claim 9 wherein said receiver further comprises a timer;

said timer being operatively associated with said release mechanism and adapted to control the release of said start bar after a random time period.

11. The race gate of claim 9 wherein said release mechanism comprising an arm interconnecting said base and said start bar.

12. The race gate of claim 10 wherein said receiver further comprising:

a first indicator that said receiver has received a signal from said wireless transmitter; and a second indicator that said start bar will move from said start position to said finish position.

13. The race gate of claim 9 wherein said race gate being operatively associated with a plurality of said race gates.

14. The race gate of claim 13 wherein said race gate being operatively associated by a method being selected from the group consisting of: mechanically, by wire, wirelessly, or combinations thereof.

15. The race gates of claim 13 wherein one race gate being a master race gate;

wherein said plurality of said race gates being slave race gates.

16. The race gate of claim 10 wherein said controller being adapted to control the release of said start bar after a preset time period and a random time period.

17. A race gate comprising:

a base;

a start bar connected to said base, said start bar being movable between a start position and a finish position;

a pedal mounted on said start bar, said pedal being an angled portion extending beyond the connection of said start bar to said base adapted to move said start bar from said finish position to said start position;

a release mechanism interconnecting said base and said start bar and being adapted to releasably hold said start bar in said start position;

said release mechanism comprising an arm interconnecting said base and said start bar;

a controller operatively associated with said release mechanism;

said controller further comprising:

a timer adapted to control the release of said start bar via said release mechanism after a preset time period and a random time period;

a receiver operatively associated with said timer; and a wireless transmitter operatively associated with said receiver.

* * * * *